US009863118B2

(12) United States Patent
Brandt et al.

(10) Patent No.: US 9,863,118 B2
(45) Date of Patent: Jan. 9, 2018

(54) CONTROL SYSTEM FOR MINING MACHINE

(71) Applicant: Caterpillar Global Mining LLC, Oak Creek, WI (US)

(72) Inventors: Michael Brandt, Racine, WI (US); James Giesfeldt, Racine, WI (US); Robert Hamann, Kenosha, WI (US)

(73) Assignee: Caterpillar Global Mining LLC, South Milwaukee, WI (US)

( * ) Notice: Subject to any disclaimer, the term of this patent is extended or adjusted under 35 U.S.C. 154(b) by 113 days.

(21) Appl. No.: 14/925,681

(22) Filed: Oct. 28, 2015

(65) Prior Publication Data

US 2017/0121932 A1 May 4, 2017

(51) Int. Cl.

| | |
|---|---|
| ***E02F 3/43*** | (2006.01) |
| ***E02F 3/30*** | (2006.01) |
| ***E02F 3/46*** | (2006.01) |
| ***E02F 9/20*** | (2006.01) |

(52) U.S. Cl.

CPC ..... *E02F 3/435* (2013.01); *E02F 3/304* (2013.01); *E02F 3/46* (2013.01); *E02F 9/2033* (2013.01)

(58) Field of Classification Search

CPC ..... E02F 3/435
USPC ..... 701/50
See application file for complete search history.

(56) References Cited

U.S. PATENT DOCUMENTS

| | | | |
|---|---|---|---|
| 4,677,579 | A | 6/1987 | Radomilovich |
| 5,408,767 | A | 4/1995 | Hazama et al. |
| 6,225,574 | B1 | 5/2001 | Chang et al. |
| 6,466,850 | B1 | 10/2002 | Hilgart |
| 6,480,773 | B1 | 11/2002 | Hilgart |
| 7,832,126 | B2 | 11/2010 | Koellner et al. |
| 8,311,970 | B2 | 11/2012 | Mcaree et al. |
| 8,355,847 | B2 | 1/2013 | Colwell et al. |
| 8,688,334 | B2 | 4/2014 | Taylor |
| 8,788,155 | B2 | 7/2014 | Claxton |
| 8,935,061 | B2 | 1/2015 | Colwell et al. |
| 8,943,714 | B2 | 2/2015 | Hren |
| 8,958,957 | B2 | 2/2015 | Hottmann et al. |
| 8,972,120 | B2 | 3/2015 | Linstroth et al. |
| 2011/0106384 | A1 | 5/2011 | Corke et al. |
| 2013/0218423 | A1 * | 8/2013 | Colwell ..... E02F 9/207 701/50 |
| 2013/0245897 | A1 | 9/2013 | Linstroth et al. |
| 2013/0249336 | A1 | 9/2013 | Voelz et al. |

(Continued)

*Primary Examiner* — Genna M Mott

(74) *Attorney, Agent, or Firm* — Leydig, Voit & Mayer, Ltd.

(57) ABSTRACT

A mining machine such as a mining shovel includes a digging assembly having an upward extending boom and a dipper assembly generally horizontally supported by the boom and configured to crowd toward and retract from a vertical bank at a mine site. To determine if the dipper assembly strikes the bank, an electronic controller can calculate a calculated crowd force based in part on a crowd motor torque associated with a crowd motor, a crowd speed of the dipper assembly, and an inertia parameter. If the calculated crowd force exceeds a predetermined first crowd threshold, the electronic controller can register an impact event. In further aspects, the electronic controller can execute a force modification function to modify the crowding forces and a speed reduction function to reduce the crowd speed.

13 Claims, 5 Drawing Sheets

(56) References Cited

U.S. PATENT DOCUMENTS

| | | | |
|---|---|---|---|
| 2014/0199147 | A1 | 7/2014 | Ryan et al. |
| 2015/0019087 | A1 | 1/2015 | Knuth et al. |

* cited by examiner

CONTROL SYSTEM FOR MINING MACHINE

TECHNICAL FIELD

This patent disclosure relates generally to a mining machine such as a mining shovel and, more particularly, to a method of controlling and enabling the machine to dig material at a mine site.

BACKGROUND

Of the various types of machines utilized in mining operations, mining shovels are responsible for digging material from a vertical bank face or other surface that may be located in a pit at the mine site and transferring the material such as mineral ore, coal, and overburden to a dump truck or other machine for transportation. Mining shovels include a boom that extends upwards into the air and at angle with respect to the bank and a dipper assembly that is supported by the boom. The dipper assembly includes a bucket-like dipper that scoops into, fills with, and removes material from the bank and that is supported by an elongated dipper arm or handle. To enable the dipper to swing upwardly into the bank, the dipper assembly is supported by the boom in a manner that allows the dipper arm to pivot and slide with respect to the boom, hence the dipper assembly has at least two degrees of freedom with respect to the boom. The pivoting motion of the dipper upwards or downwards with respect to the boom may be referred to as hoisting. The sliding translation of the dipper arm with respect to the boom may be referred to as crowding, when proceeding in the direction of outward extension from the mining shovel, or retraction when proceeding in the direction of inward retraction or motion back towards the mining shovel.

When the dipper impacts and penetrates into the bank and fills with material, the mining shovel is subjected to severe forces and stresses. The magnitude of these forces and stresses may possibly damage the mechanical components and operational systems of the mining shovel. Further, if the dipper assembly strikes the bank at an incorrect angle of attack, "boom jacking" may occur in which the crowding dipper assembly is pushed back against the boom and may cause the boom to pivot upwardly then drop and bounces with respect to the mining shovel. To assist operators in controlling the mining shovel to accommodate these applied forces, manufacturers often configure mining shovels with computer-implemented control systems that regulate the motions and power outputs of the mining shovel during the digging operation.

One example of a control system is provided in U.S. Pat. No. 8,935,061 ("the '061 patent"). The '061 patent describes a control system which monitors forces produced by the machine including a crowd force and a hoisting force, called the hoist bail pull, used for lifting and lowering the dipper assembly into the bank. This information is used in part to control operation of a crowd motor that is responsible for crowding out and retracting in the dipper assembly to prevent the reaction forces directed backwards from attempting to tip the machine or causing a boom jack. The present disclosure is directed to providing a control system for a mining shovel or similar machine to similarly assist in operation of the machine when digging.

SUMMARY

The disclosure describes, in one aspect, a mining machine including a digging assembly having a boom extending generally upwardly between a lower end and an upper end and a dipper assembly supported by the boom. The dipper assembly further includes a dipper arm and a dipper disposed at a first end of the dipper arm. The mining machine further includes a crowd system slidably moving the dipper assembly with respect to the boom in a crowd direction and in a retraction direction. The crowd system can include a crowd motor and an actuator-operatively associated with the crowd motor and arranged to slide the dipper arm with respect to the boom. The mining machine further includes an electronic controller operatively associated with the crowd system and in electronic communication with the crowd motor. The electronic controller is configured to receive a crowd speed and a crowd motor torque, to calculate a calculated crowd force based in part on the crowd speed and the crowd motor torque, and to detect an impact event where the dipper assembly impacts a surface at a mining site based on the calculated crowd force.

In another aspect, the disclosure describes a method of operating a mining machine to determine if it has struck a surface at a mine site. The method crowds a dipper assembly supported by a boom arranged in an upward orientation on the machine toward the surface. The method further monitors a crowd motor torque output from a crowd motor operatively associated with the dipper assembly and monitors a crowd speed associated with the dipper assembly. The method calculates a calculated crowd force based in part on the crowd motor torque, the crowd speed, and an inertia parameter associated with the dipper assembly. If the calculated crowd force exceeds a first crowd threshold the method can register that an impact event has occurred.

In yet a further aspect, the disclosure describes an electronic controller for a mining machine having a dipper assembly slidably supported on a boom extending upwardly with respect to the mining machine. The electronic controller can execute an impact detection function to determine if the dipper assembly impacts a surface at a mine site. To make the determination, the impact detection function calculates a calculated crowd force based in part on a crowd motor torque output from a crowd motor that is arranged to slide the dipper assembly with respect to the boom, a crowd speed of the dipper assembly sliding with respect to the boom, and an inertia parameter associated with the dipper assembly. The electronic controller also executes a force modification function configured to modify the crowd motor torque by calculating a torque command modifier based on a difference between the calculated crowd force and a first crowd threshold if the impact event is detected.

DETAILED DESCRIPTION

Figure 1:
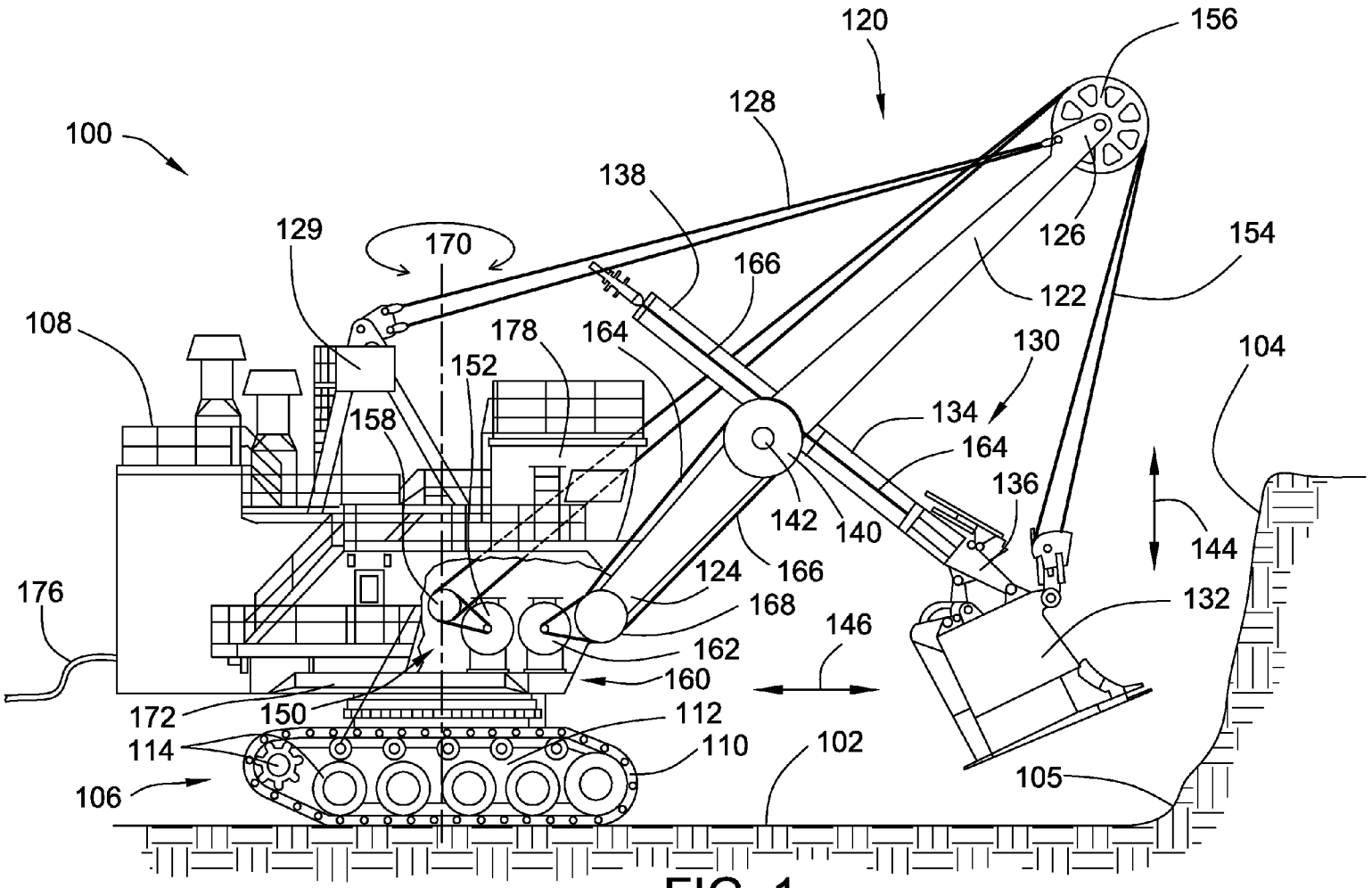
FIG. 1 is a side elevational view of a machine, in the embodiment of a mining shovel, including a boom, a dipper assembly, and a crowd system for digging material at a mine and which is configured with an electronic controller to control the mining shovel in accordance with the disclosure.

This disclosure relates to mining machines for digging, moving, and unloading material about a mine site as part of a mining operation. Now referring to FIG. 1, wherein like reference numbers refer to like elements, there is illustrated a mining machine of the foregoing type and, in the particular embodiment, a mining shovel 100 which can be configured to crowd into, excavate, and remove material from a vertical face or bank of a pit mine. However, in addition to mining shovels, aspects of the disclosure may be applicable to other mining machines for digging and excavating such as excavators, draglines, and the like. The illustrated mining site may be formed as a pit mine and may include a relatively horizontal ground surface 102 that may be disposed below a substantially vertical face of a bank 104 or pit wall which intersects the ground surface at a toe 105.

In an embodiment, the mining shovel 100 may be mobilized so that it can move about the ground surface 102 during operation but, in other embodiments, the mining shovel may be temporarily or permanently fixed in place. To allocate mobility and digging functions, the mining shovel 100 may include an undercarriage 106 and an upper structure 108 that is supported on the undercarriage. To propel the mining shovel 100 over the ground surface 102, the undercarriage 106 may be configured with one or more propulsion devices such as continuous tracks 110, sometimes referred to as caterpillar tracks. The continuous tracks 110 form a closed loop that can translate with respect to a frame 112 of the undercarriage 106 that includes a drive sprocket, rollers, and/or idlers 114 to facilitate translation of the tracks in a manner to propel the mining shovel 100. The mining shovel 100 can thus propel itself in the forward or rearward directions or turn itself towards either side. In an embodiment, multiple continuous tracks 110 can be provided on each side of the undercarriage 106. In a further embodiment, the undercarriage 106 may include rotatable wheels or other propulsion devices.

To dig and remove material from the bank 104 or a similar vertical face at the mine site, a digging assembly 120 may be disposed at the front of the upper structure 108 and thus may be referred to as a front end. The digging assembly 120 can include a boom 122, which may be an elongated, beam-like structure that is pivotally connected at its lower end 124 with pins to the upper structure 108. The boom 122 can extend upwardly from the upper structure 108 to its upper end 126 and may be angled in the forward direction at, for example, a 60° angle. To support the boom 122 in its upward extending, angled orientation, one or more suspension ropes 128 can be attached to the upper end 126 and extend back down to an A-frame shaped backstay 129 disposed on the upper structure 108. The boom 122 can support a dipper assembly 130 that includes a bucket-like dipper 132 that can penetrate into and fill with material from the bank 104. The dipper 132 may be supported by a dipper arm 134 or dipper handle that may be an elongated, arm-like structure that extends between a first end 136 connected to the dipper and a distal second end 138. During a digging operation, the dipper assembly 130 can swing upwardly into the bank 104 while projecting forwardly, or crowding, into the bank. To enable the swinging or scooping motion of the dipper 132 into the bank 104, the dipper assembly 130 is configured to pivot and slide with respect to the boom 122.

To facilitate pivoting and sliding of the dipper assembly 130, a saddle block 140 connects the dipper arm 134 to the boom 122. The saddle block 140 can be pivotally connected to the boom 122 at a pivot point 142 located between the fixed lower end 124 and the free upper end 126. Hence, when the dipper arm 134 is supported in the saddle block 140, the dipper arm can pivot or articulate with respect to the boom 122, thereby moving the dipper 132 upwardly and downwardly in the vertical direction 144 in movements that may be referred to as hoisting or lowering. To allow the dipper assembly 130 to translate or slide with respect to the boom 122 in the forward-reverse direction 146, the saddle block 140 can form a sleeve or cradle supporting the dipper arm 134 and which engages the dipper arm via appropriate bearings, rollers, or the like. Extension of the dipper assembly 130 in the forward-reverse direction 146 toward the bank 104 may be referred to as crowding the dipper assembly and retraction of the dipper assembly away from the bank may be referred to as retraction or retracting the dipper assembly.

To cause relative movement of the components of the digging assembly 120, the mining shovel 100 can include various motors, actuators, and rigging that are operatively associated with each other. For example, to hoist or lower the dipper 132 in the vertical direction 144, the mining shovel 100 can include a hoist system 150 that is powered by an electric hoist motor 152. The hoist motor 152, which may be an alternating current ("AC") motor of suitable power to lift and lower the dipper assembly 130 and the dipper 132 when filled with material, may be disposed in the upper structure 108. To transfer motive power from the hoist motor 152 to the dipper assembly 130, one or more hoist ropes 154 or cables can be attached to the dipper 132 and extend upwardly and around a sheave 156 or pulley rotatably disposed at the upper end 126 of the boom 122. The hoist ropes 154 wrap partially around the rotatable sheave 156 to generally reverse their direction and extend back down and wind around a hoist winch 158 or drum disposed in the upper structure 108. The hoist winch 158 is operatively coupled with the hoist motor 152. Hence, operation of the hoist motor 152 rotates the hoist winch 158 to wind up or pay out the hoist ropes 154 causing the dipper assembly 130 to pivot about the pivot point 142 up or down along the vertical direction 144. The weight of the dipper assembly 130 is partially supported by the hoist ropes 154 that also pull the boom 122 in tension against the suspension ropes 128.

To cause the dipper assembly 130 to translate with respect to the boom 122 by crowding out or retracting in along the forward-reverse direction 146, the mining shovel 100 can also be equipped with a crowd system 160. The crowd system 160 can also be powered by an electric crowd motor 162 disposed in the upper structure 108. To convert rotation of the crowd motor 162 to translation of the dipper assembly 130, the crowd system 160 can include an appropriate crowd actuator operatively interconnected with the dipper arm 134. In the illustrated embodiment, the actuator may be a rope system or rigging which includes a first crowd rope 164 and a second crowd rope 166. The first crowd rope 164 can attach to the dipper arm 134 proximate to the first end 136 and the second crowd rope 166 can attach to the dipper arm proximate to the second end 138. The first and second crowd ropes 164, 166 extend along the length of the dipper arm 134 back toward the saddle block 140 and can partially wrap around the saddle block 140 to be redirected toward one or more crowd winches 168 or drums disposed in the upper structure 108. The rotatable crowd winch 168 is operatively coupled to the crowd motor 162. Rotation of the crowd winch 168 in one direction will pay out the first crowd rope 164 while winding up the second crowd rope 166 causing the dipper assembly to crowd forward toward the bank 104. Rotating the crowd winch 168 in the opposite direction winds up the first crowd rope 164 while paying out the second crowd rope 166 thereby retracting the dipper assembly 130.

In a further embodiment, the mining shovel 100 may be configured as a hydraulic mining shovel in which the crowd system 160 is associated with one or more hydraulic cylinders that may be disposed proximate the saddle block 140 and that can be used to crowd and retract the dipper assembly 130 with respect to the boom 122. In such an embodiment, the hydraulic cylinder functionally replaces the first and second crowd ropes 164, 166. The hydraulic cylinder can be operatively associated with a hydraulic system in which hydraulic fluid is pressurized by operation of the crowd motor 162 to extend and retract the dipper assembly 130.

In addition to the crowding and hoisting motions used to dig material from the bank 104, the mining shovel 100 can be configured to swing the digging assembly 120 about a vertical axis 170, as indicated by the arrow, so the dipper assembly 130 moves horizontally over the ground surface 102 to and from the bank 104. Swinging the mining shovel can be used to, for example, position the dipper 132 over the body of a dump truck and release the extracted material. To enable the swinging motion, the upper structure 108 has a rotatable platform 172 or turn table that is rotatable with respect the upper structure to the undercarriage 106. To provide power for the various motors, systems, continuous tracks, and the like, the mining shovel 100 includes an electrical system that receives three-phase electrical power through a trail cable 176 from an offboard electrical source and distributes the power to the motors and other components on the mining shovel. In an alternative embodiment, the mining shovel may include an onboard prime mover such as an internal combustion engine for combusting and converting hydrocarbon based fuel to mechanical power. To accommodate an operator and the controls, gauges, and readouts for operating the mining shovel 100, an operator's station 178 can be disposed on the upper structure 108 at a location that provides a view towards the digging assembly 120.

Figure 2:
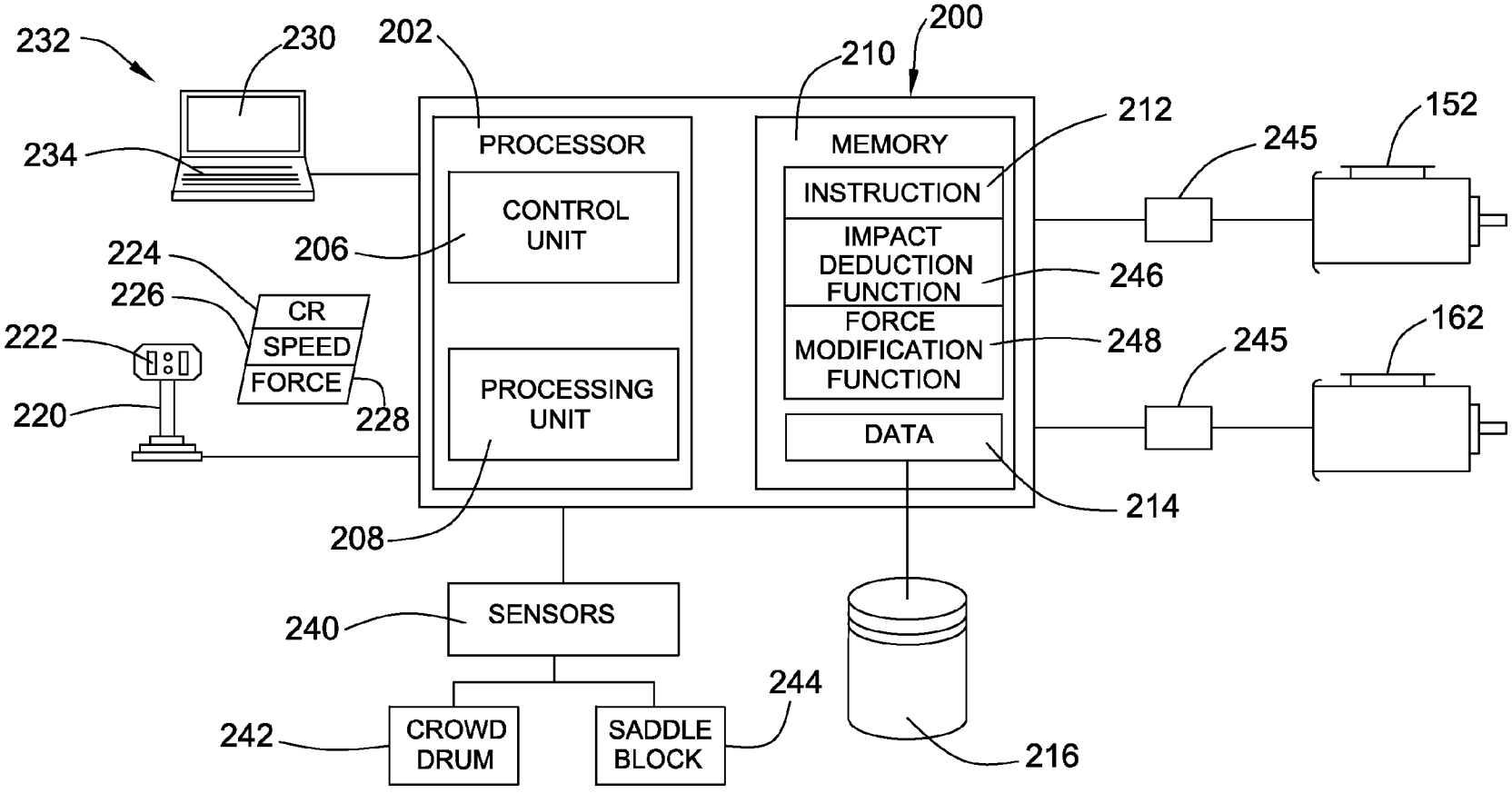
FIG. 2 is a schematic diagram representing an electronic controller operatively associated with various other components of the mining shovel for implementing the control system.

Referring to FIG. 2, to facilitate and coordinate operation of the various components of the mining shovel, the mining shovel can include an electronic control unit ("ECU") or a computerized electronic controller 200, which is represented schematically with the corresponding controllable components and devices of the mining shovel. The electronic controller 200 can have any suitable computer architecture and can be in electronic communication with the various components on the mining shovel to send and receive electronic signals in digital or analog form with the components that enable the electronic controller to monitor and regulate the operations and functions of the mining shovel. The electronic controller 200 may execute and process functions, steps, routines, control maps, data tables, charts, and the like saved in and executable from computer readable and writable memory or another electronically accessible storage medium to control the mining shovel. To perform these functions and operations, the electronic controller 200 can include a processor 202 such as a central processing unit or microprocessor or, in other embodiments, an application specific integrated circuit (ASIC) or other appropriate processing circuitry. The processor 202 may further include a control unit 206 that is responsible for regulating its internal and external operations, such as receiving and loading applications and programs, reading and writing data to and from memory, and communicating with the other electronic components of the mining shovel. The processor 202 can also include a processing unit 208 responsible for executing the instructions associated with the programs and applications. To enable digital processing of data and execution of applications and programs, the processing unit 208 can be made of any of various gates, arrays, and other digital logic components.

To store data for processing and the instructions associated with programs and applications, the electronic controller 200 may include memory 210 or other data storage capabilities. The memory 210 may be further separated into instruction memory 212 that stores the instructions associated with the applications and programs and data memory 214 that is responsible for storing the data processed by the applications and programs. The memory 210 can include any suitable type of electronic memory devices such as random access memory ("RAM"), read only memory ("ROM"), dynamic random access memory ("DRAM"), flash memory and the like. In addition to the forgoing types of electronic memory, in a different embodiment, the memory 210 may include magnetic or optical accessibility. For more permanent storage, the electronic controller 200 can also read and write information to and from a separate database 216. The database 216 can include tables, data structures, libraries, and the like for organizing information in a manner that can be readily utilized by the electronic controller 200. Although in the illustrated embodiment, the electronic controller 200 and its components are illustrated as a single, discrete unit, in other embodiments, the electronic controller and its functions and operations may be distributed among a plurality of distinct and separate components such as electronic control units ("ECUs"), programmable logic controllers ("PLCs"), etc.

To interface with an operator of the mining shovel, the electronic controller 200 can be operatively associated with and in electronic communication with one or more operator input devices such as a joystick 220 or the like. The operator can manipulate the joystick 220 to produce digital or analog signals that are used to steer the mining shovel and to control movement of the digging assembly during digging operations. The joystick 220 can include toggles, dials, or buttons 222 to enable further input from the operator. The inputs directed through the joystick 220 can include a crowd command 224 or crowd reference in the form of electrical signals that represent the desired operation of the digging assembly according to the operator. The crowd command 224 may further include or be separated into a crowd speed command 226 and a crowd force command 228 corresponding to how fast the operator desires the crowd assembly to operate and with how much force or power. The inputs from the joystick 220 may include other commands and directions as well.

To provide the operator with visual information regarding the operation and performance of the mining shovel, the electronic controller 200 can also communicate with a human-machine interface ("HMI") that includes a visual display device 230 such as a liquid crystal display ("LCD") and may also include audio capabilities. The visual display device 230 can be part of a portable notebook computer 232 located in the operator's station of the mining shovel; however, in other embodiments, the visual display device may be provided as a permanent installation of the operator station. Examples of visual information can include machine speed, engine load, electric motor performance, and the positions and forces being applied to the digging assembly. The notebook computer 232 can also include a keyboard 234 to facilitate its function as a HMI by allowing the operator to enter information and directions to the electronic controller 200. It should be noted, however, that the operator controls, inputs, and displays illustrated in FIG. 2 are by way of example only and may include different arrangements or controls in different embodiments.

In addition to the operator controls, to receive information about the status and operation of the mining shovel, the electronic controller 200 can be in electronic communication with various sensors 240 disposed about the mining shovel and that monitor and measure different operating parameters. In particular, the sensors 240 can send digital or analog data to the electronic controller 200 and may include motion or displacement sensors, Hall effect sensors, strain or load gages, voltage meters, current meters, temperature sensors, pressure sensors, and the like. In the illustrated embodiment, the plurality of sensors 240 can include a crowd winch sensor 242 that measures the force or load being applied to the crowd winch and a saddle block sensor 244 that measures activity of the saddle block such as the pivoting or crowding movements of the dipper assembly. The sensors 240 can be arranged in networked communication with each other and with the electronic controller 200 in a controller area network ("CAN") via a bus that physically conducts the electronic signals; however in other embodiments, communication may occur wirelessly through Wi-Fi, Bluetooth, or other communication standards.

To direct and control operation of the digging assembly of the mining shovel, the electronic controller 200 can be operatively coupled to the electric motors associated with the digging assembly and specifically with the hoist motor 152 and crowd motor 162. The electronic controller 200 can process and interpret the control signals or commands input through the joystick 220 and the notebook computer 232 by the operator and thereby operate the hoist motor 152 and the crowd motor 162 accordingly to produce the desired motions on the crowd system and the hoist system. For example, the electronic controller 200 can switch the electrical power from a generator or the like to the hoist motor 152 and crowd motor 162 on and off and may reverse the directions of the motors to pay out or take in the hoist and crowd ropes as desired. To regulate power to the hoist and crowd motors 152, 162, one or more electrical power regulators 245 may be disposed between the electronic controller 200 and the motors that adjust the applied current and voltage levels based on signals from the electronic controller to achieve the desired output speed, torque, and motor direction. In further embodiments, the electronic controller 200 can also be operatively associated with the hoist winch and the crowd winch to rotatably engage and disengage the winches from the respective hoist and crowd motors 152, 162. As can be appreciated, the electronic controller 200 can be responsible for regulating and controlling other aspects of the mining shovel such as the continuous tracks used to propel the mining shovel and the electrical power system that functions as the primary power source for the mining shovel.

For example, according to an aspect of the disclosure, the electronic controller 200 can be configured to assist the operator of the mining shovel in performing a digging operation. In particular, the electronic controller 200 can be configured to determine if the dipper impacts and penetrates into the bank of the mine site, which may be difficult for the operator to visually observe due to the location of the operator's station and the velocity of the crowding dipper assembly. For example, referring back to FIG. 1, at the start of the digging operation, the operator may initially position the dipper 132 proximate to the toe 105. Maneuvering the dipper assembly 130 to this location involves relatively low forces, well within the capacity of the hoist motor 152 and crowd motor 162, because the mining shovel 100 only moves the dipper assembly through empty space. To engage the bank 104, the operator moves the dipper assembly 130 in the vertical direction 144 and the forward-reverse direction 146 to crowd into and penetrate the bank with the dipper 132. Striking the bank 104 generates substantial impact and reactionary forces, which may be even larger if the toe 105 is hard or frozen.

Accordingly, to determine whether the dipper strikes the bank, referring to FIG. 2, these instructions can include an impact detection function 246 that utilizes information readily obtainable from the other systems of the mining shovel at the time of impact to assess whether the dipper struck the bank. The impact detection function 246, which may be in the form of an executable routine or application program including computer executable instructions, can be stored in the instruction memory 212 of memory 210 and that can be loaded and executed in the processing unit 208 of the processor 202. In addition, because striking the bank with the dipper assembly generates significant reactionary forces that propagate through the structure of the digging assembly and the mining shovel, the instructions can include a force modification function 248 to reduce the potential effects of these reactionary forces and facilitate engagement with the bank.

Figure 3:
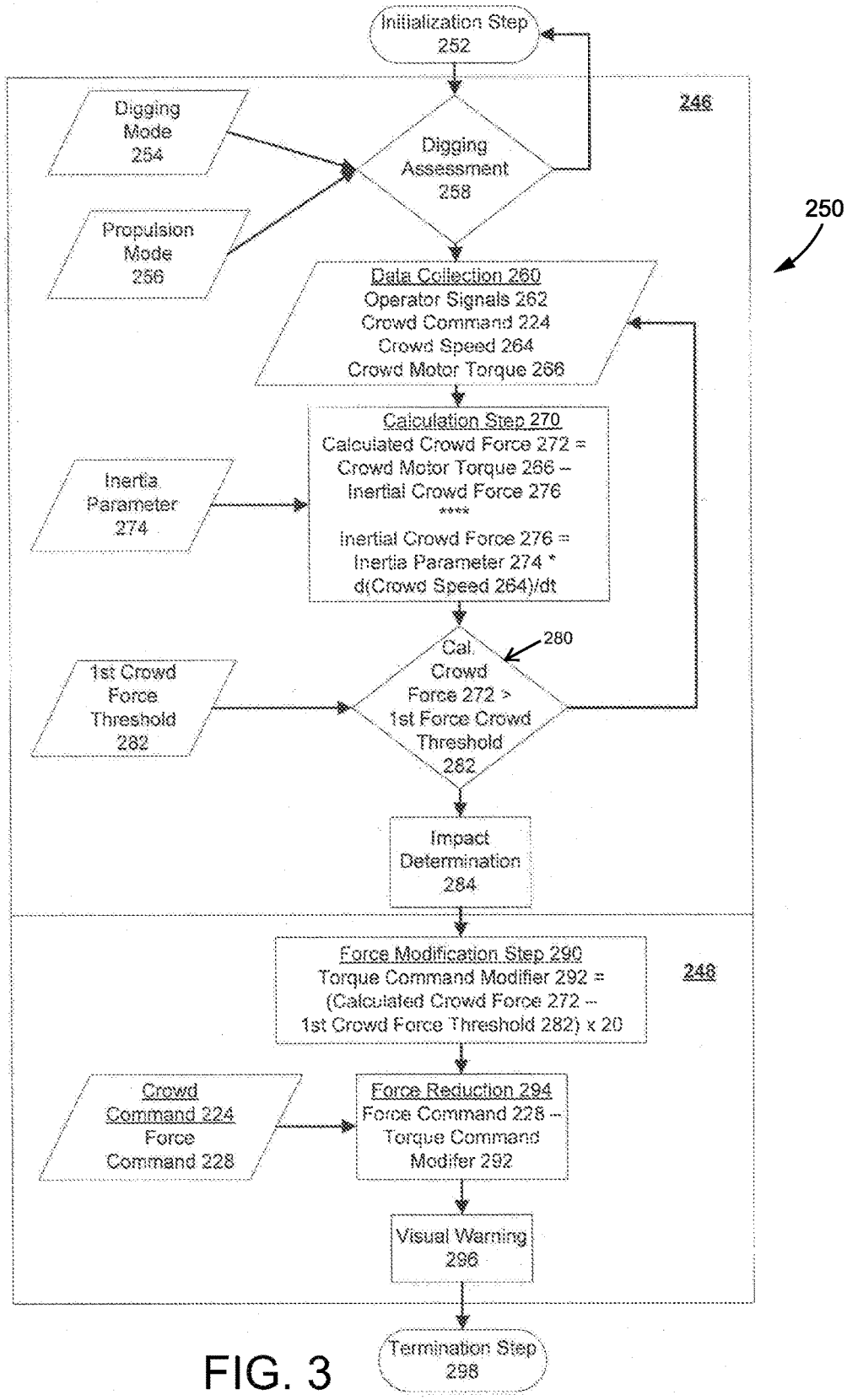
FIG. 3 is a flowchart representing a possible process or routine for determining if a dipper assembly on the mining shovel is digging into a bank based on a calculated crowd force applied to the crowd system.

Referring to FIG. 3, there is illustrated a flowchart of a possible computer executable process 250 or routine for conducting the impact detection function 246 and force modification function 248. Although FIG. 3 illustrates a possible sequence or order of steps, steps may be omitted or added and may be performed in any possible alternative order. The process 250 can start with an initialization step 252 in which the programming instructions are loaded into the processing unit of the processor for execution in the electronic controller. In an embodiment, the mining shovel can be configured to operate in various different modes including, for example, a digging mode 254 for conducting the digging operation and a propulsion mode 256 for propelling the mining shovel over the ground surface about the mine site. Since the process 250 needs to be active only during a digging operation, the process can perform a digging assessment step 258 to determine whether the operator has selected or enabled either the digging mode 254 or the propulsion mode 256. If the propulsion mode 256 or a different mode is currently selected, the digging assessment step 258 can return to the initialization step 252 until the digging mode 254 is enabled.

If, however, the digging assessment step 258 affirmatively confirms that the mine shovel is in the digging mode 254, the process 250 can proceed to a data retrieval or data collection step 260 in which various data inputs are collected by the electronic controller. These data inputs can be determined using the sensors operatively associated with the electronic controller and disposed about the mining shovel. The electronic controller may already collect these data inputs in conjunction with the routine operation of the mining shovel. Examples of these data inputs can include operator references, commands, or input signals 262 from the joystick such as the crowd command 224, the crowd speed 264 and crowd motor torque 266 associated with the crowd system, and any other suitable inputs. The crowd motor speed 264 may correspond to the voltage drawn by the crowd motor and the crowd motor torque 266 may correspond to the current drawn by the crowd motor. As explained below, in other embodiments, the crowd speed 264 maybe measured differently. The electronic controller may monitor the data inputs continuously on a real-time basis so that the process 250 is reflective of real-time conditions. The data inputs may be in digital or analog form.

To perform the impact detection function 246 and estimate whether the dipper strikes the bank, the process 250 can conduct a calculation step 270 to determine a calculated crowd force 272 that can represent the forces being applied to the crowd system. In a particular embodiment, the calculated crowd force 272 may correspond to the actual forces and stresses acting on the crowd system, such as a tension or lack of tension on the crowd ropes, separated from other forces, stresses, or moments being applied or occurring elsewhere on the mining shovel, and may therefore correspond to the forces acting with respect to the dipper at an instantaneous moment. The calculated crowd force 272 can be evaluated to determine whether the dipper has struck the bank.

In an embodiment, the calculation step 270 can proceed using the physical law that force equals mass times acceleration, as determined according to the following equation:

$$F=M*A \quad \text{(Eqn. 1)}$$

The terms of the equation, and thus the calculated crowd force 272, are isolated with respect to the crowd system. To provide the acceleration term, the speed of the dipper assembly moving in translation with respect to the boom is determined based on the crowd speed 264 that represents how fast the crowd motor is paying out or taking up the crowd ropes. As can be appreciated, the crowd speed corresponds to and can be converted to dipper assembly speed or velocity using known geometric correlations and dimensions obtained from the structure of the mining shovel. In another embodiment, the speed or velocity of the dipper assembly may be determined directly by, for example, measuring translation of the dipper arm with respect to the saddle block. Directly measuring the speed and/or displacement of the dipper arm with respect to the saddle block may be advantageous in those embodiments in which a hydraulic cylinder is utilized to crowd and retract the dipper assembly as opposed to crowd ropes. The process 250 can convert the crowd speed 264 to the crowd acceleration by taking the derivative of the crowd speed, thereby determining the change in speed over time, according to the following equation:

$$\text{Acceleration}=dv/dt \quad \text{(Eqn. 2)}$$

Hence, through Eqn. 2, the process 250 indirectly calculates crowd acceleration of the dipper assembly using readily obtainable information such as crowd speed 264 rather than directly attempting to measure acceleration of the dipper assembly. The crowd speed 264, and thus the calculated crowd acceleration variable, can be positive or negative, depending upon whether the dipper assembly is crowding or retracting with respect to the boom and bank, and the units may be in meters per second$^2$ or m/s$^2$. To determine the mass term in Eqn. 1, an inertia parameter 274 can be estimated or determined that is associated with the mass of the dipper assembly. In particular, the inertia parameter 274, representing the resistance to the change in motion of the dipper assembly with respect to the boom, can be estimated using known masses for the dipper assembly and the other components of the crowd system as determined during design and manufacture of the mining shovel. In some embodiments, the inertia parameter 274 may be a static value, while in other embodiments, it may vary based on operational characteristics, component location and the like. The units for the estimated inertia parameter 274 may be in kilograms per meter$^2$ or Kg/m$^2$.

The forces associated with the crowd system can be calculated according to Eqn. 1 above to determine an inertial crowd force 276, which may correspond to the total forces accelerating the dipper assembly in either the crowd or the retraction directions. This can be done according to the following modified version of Eqn. 1:

$$\text{Inertial Crowd Force}=\text{Inertia Parameter}*(dv/dt) \quad \text{(Eqn. 3)}$$

In the embodiments utilizing a hydraulic cylinder to actuate the crowd system, the crowd force 276 may be determined based on other factors, such as the fluid pressure differential in the hydraulic cylinder between the cap end and the head end of the cylinder, instead of employing an inertia factor. This quantity may equate to the total forces being applied to the hydraulic cylinder by the crowd motor and the dipper assembly. To further isolate the actual forces applied to the crowd actuator, and in particular the crowd ropes alone, the inertial crowd force 276 can be subtracted from other forces being applied to the crowd system from the other components of the mining shovel. The other forces may correspond to the output torque being generated by the crowd motor. The output torque corresponds to the crowd motor torque 266 collected during the data collection step 260. This determination produces the calculated crowd force 272 according to the following equation:

$$\text{Calculated Crowd Force}=\text{Crowd Motor Torque}-\text{Inertia Value}*\text{Crowd Acceleration} \quad \text{(Eqn. 4)}$$

or $$\text{Calculated Crowd Force}=\text{Crowd Motor Torque}-\text{Inertia Parameter}*(dv/dt) \quad \text{(Eqn. 5)}$$

The calculated crowd force 272 represents the actual forces applied externally to the dipper assembly, as experienced by the crowd ropes, by engagement with the material of the bank, i.e., the net forces on the crowd system minus the torque applied to the crowd system from the crowd motor. In other words, the calculated crowd force 272 represents the portion of the net total force applied to the crowd system that arises from penetration of the dipper into the bank, including any momentary reactionary forces generated when the dipper initially impacts the bank. The calculated crowd force 272 may therefore better represent the effect of striking the bank with the dipper assembly than directly measuring the crowd motor torque 266, where the output torque may be also utilized to overcome frictional resistance of the components of the crowd system rather than engaging the dipper into the bank.

To ensure the dipper has actually struck the bank with significant force, the process 250 can conduct a comparison step 280 in which the calculated crowd force 272 is further compared to a first crowd force threshold 282. The first crowd force threshold may be a static, predetermined value such as a minimum or maximum quantity or may be dynamically determined based on operational characteristics of the mining shovel. For example, the first crowd force threshold 282 can correspond to a threshold value of the net forces the crowd system may be anticipated to withstand, or it can be based on a capacity of the crowd motor. As a further example, in an embodiment, the first crowd force threshold 282 can be a percentage of the full motor torque capacity rating for the crowd motor such as 100% of the maximum rated torque capacity or the maximum continuous stall torque of the crowd motor. The comparison step 280 can occur according to the following equation:

$$\text{Calculated Crowd Force} > \text{First Crowd Force Threshold.} \quad \text{(Eqn. 6)}$$

When the dipper initially impacts the bank, the reactionary forces represented by the calculated crowd force 272 can exceed the torque capacity associated with the crowd motor and represented by the first crowd force threshold 282, possibly by twice as much. Therefore, if the calculated crowd force 272 exceeds the first crowd force threshold 282, the process 250 can determine the occurrence of an impact event 284 confirming the dipper has struck the bank, thereby completing the impact detection function 246. By setting the first crowd force threshold 282 to the maximum rated torque capacity of the crowd motor, the process 250 can disregard incidental or minimal impacts, such as setting the dipper on the ground surface, that are safely within the capabilities of the mining shovel.

In furtherance with the disclosure, in an embodiment, the process 250 may proceed with additional steps to perform the force modification function 248 to adjust the forces generated by the crowd system as the dipper penetrates into the bank. Referring back to FIG. 1, to provide the force required to further penetrate the bank 104 after the initial impact with the dipper 132, the operator may want to rely primarily on the inertia or momentum associated with the dipper assembly 130 from the initial maneuvering of the dipper assembly proximate to the toe 105. Relying on inertia and momentum may reduce the impact forces propagating through the dipper assembly 130 and the digging assembly 120 that could apply undue stress on the components of the hoist and crowd systems 150, 160. Further, reliance on inertia and momentum may reduce stresses on the hoist and crowd motors 152, 162 to avoid overloading the motors when penetrating the bank 104.

Accordingly, referring to FIG. 3, once the process 250 registers the impact event 284, the process can proceed to execute the force modification function 248 to reduce or limit the torque output of the crowd motor. In an embodiment, the force modification function 248 may perform a force modification step 290 to modify the forces output from the crowd motor in response to the impact event 284. In particular, the force modification step 290 can determine a torque command modifier 292 and apply it to reduce the crowd force requested by the operator of the mining shovel. The torque command modifier 292 can be proportionally correlated to the amount that the calculated crowd force 272 exceeds the first crowd threshold 282, such that the reduction in crowd motor output torque gradually increases with the calculated crowd force. Accordingly, to calculate the torque command modifier 292, the force modification step 290 can determine the difference between the calculated crowd force 272 and the first crowd force threshold 282. Hence, the larger the calculated crowd force 272, the larger the quantity of the torque command modifier 292 to reduce the crowd motor output.

To scale up the torque command modifier 292 relative to the torque or forces at issue, the force modification step 290 may further compute the torque command modifier as a multiplier of the difference between the calculated crowd force 272 and the first crowd force threshold 282. This enlarges the torque command modifier 292 to timely reduce the crowd motor output. For example, the torque command modifier 292 may be twenty (20) times the difference between the calculated crowd force 272 and the first crowd force threshold 282, though other multipliers are acceptable. The process 250 can perform a force reduction step 294 in which the torque command modifier 292 is subtracted from the crowd force command 228 requested by the operator, which may be received as part of the crowd command 224 input through the joystick. Hence, the process 250 reduces the crowd force requested by the operator at the time of impact and penetration of the dipper into the bank in a manner that correlates the reduction with the excess forces applied to the crowd ropes. In other words, after impact, the inertia and momentum of the dipper assembly may be primarily responsible for penetration rather than the crowd motor. To notify the operator the process 250 is modifying the requested forces, the process can provide a visual warning 296 or other warning that can appear on the visual display screen in the operator's station. The process 250 may terminate in a termination step 298 or may return to an earlier step, such as the initialization step 252 or data collection step 260, to repeat the process with updated data and information.

Figure 4:
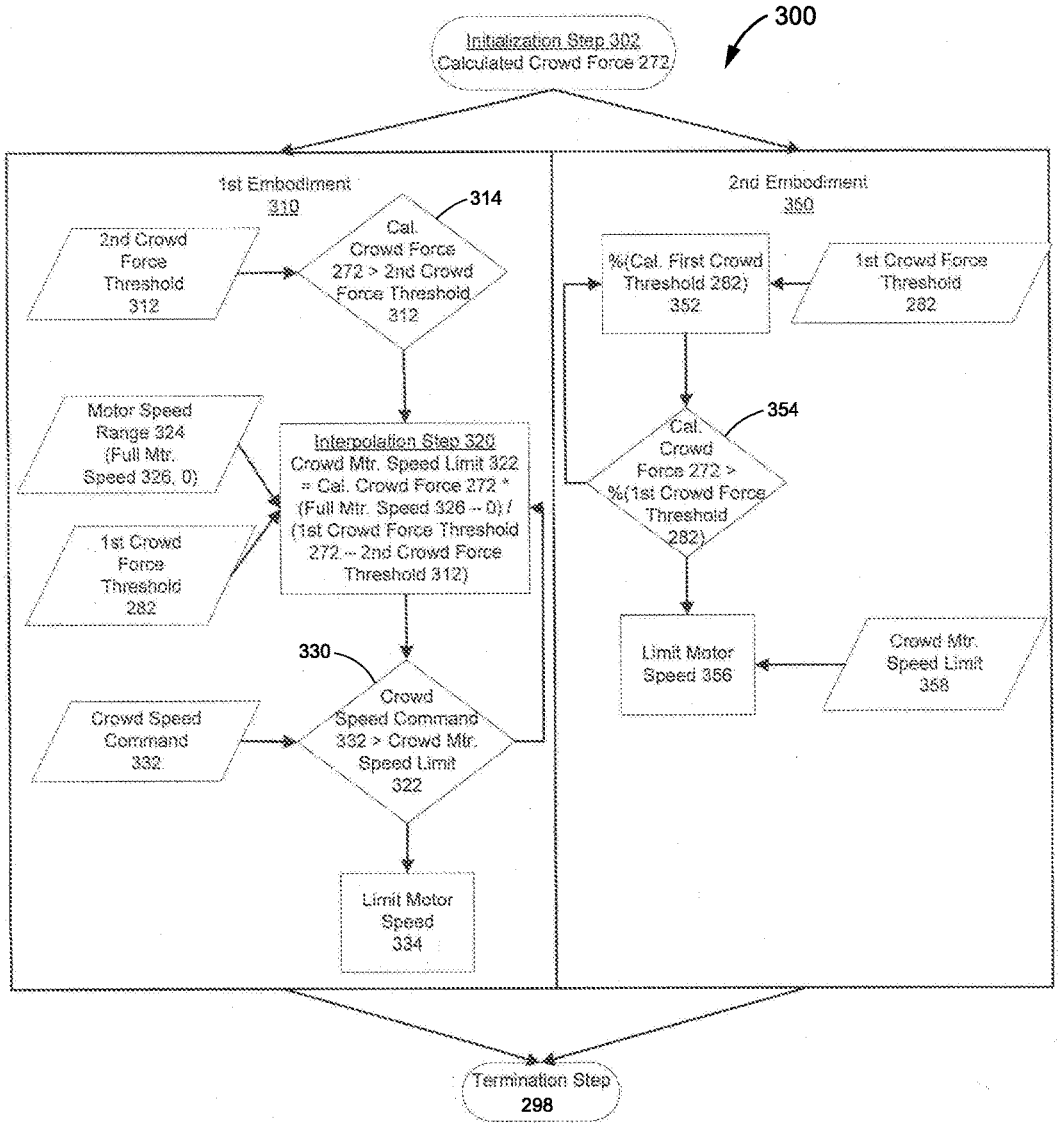
FIG. 4 is a flowchart representing a possible process or routine for modifying the force or torque output from a crowd motor associated with a crowd system on the mining shovel if the electronic controller determines the dipper assembly is digging into a bank.

Referring to FIG. 4, in further embodiments, the electronic controller 250 can execute a speed reduction function 300 to also reduce or limit the speed at which the dipper assembly penetrates into the bank. Once the dipper impacts and penetrates into the bank, it becomes unnecessary to translate the dipper assembly at full velocity. Accordingly, to reduce the speed or velocity of the dipper assembly, the speed reduction function 300, in an initial initialization step 302, can receive the calculated crowd force 272 from the prior processes and assesses the calculated crowd force to compute the speed reduction. In a first embodiment 310, the speed reduction function 300 can limit or reduce the speed based on the calculated crowd force 272 and a second crowd force threshold 312. The second crowd force threshold 312 may be a predetermined, static value such as a minimum or maximum quantity or may be determined dynamically based on the operational characteristics of the mining shovel. The second crowd force threshold 312 can also be based on the rated capacity of the crowd motor, for example, 50% of the rated maximum capacity or rated continuous stall torque. In a second comparison step 314, the second crowd force threshold 312 is compared to the calculated crowd force 272 to determine whether to limit the crowd speed. Using the second crowd force threshold 312 to initiate speed reduction ensures speed reduction occurs only when significant forces and velocities are at issue and that the crowd motor is operating above specific ranges that it could otherwise accommodate.

If the second comparison step 314 determines the calculated crowd force 272 exceeds the second crowd force threshold 312, the speed reduction function 300 can perform an interpolation step 320 to the determine a crowd motor speed limit 322 to apply to the crowd motor during penetration. The interpolation step 320 can be used to convert the comparisons made between the forces or torques obtained through the calculation processes, in units of foot-pounds or newton-meters, to corresponding values of speed or velocity, in units of feet or meters per second. The interpolation step 320, in general, determines the relative position of the value of the calculated crowd force 272 within a range of force values, then converts or translates a comparable value for the crowd speed within a similar range of speed values.

In the illustrated embodiment, to perform the interpolation step 320, data about the crowd motor speed range 324 is received, which may have a range from a full motor speed 326 in units of, for example, RPM or hertz, to a minimum value of zero, thus the crowd motor speed range 324 is delineated by the range (Full Motor Speed 326, 0). For the force or torque variables, in units of foot-pounds or newton-meters, the interpolation step 320 can assume a crowd motor force range 328 that includes and is capped by the first crowd force threshold 282 and the second crowd force threshold 312, or a crowd motor force range delineated by the range (first crowd force threshold 282, second crowd force threshold 312). Using a linear interpolation equation provided below, the interpolation step 320 converts the calculated crowd force 272 to the crowd motor speed limit 322.

(Full Motor Speed−0)/Calculated Crowd Force*(1st Threshold−2nd Threshold)=Crowd Motor Speed Limit (Eqn. 7)

The crowd motor speed limit 322, in units of RPM, hertz, feet per second, meters per second, etc., as interpolated is therefore related or corresponds to the amount the calculated crowd force 272 exceeds the predetermined first crowd force threshold 282. The interpolation step 320 thus completes the following matrix:

| INTERPOLATION MATRIX | FORCE | SPEED |
|---|---|---|
| MAXIMUM | First Crowd Force Threshold 282 | Full Motor Speed 326 |
| VALUE | Calculated Crowd Force 272 | Crowd Motor Speed Limit 322 |
| MINIMUM | Second Crowd Force Threshold 312 | Zero (0) |

To determine if a reduction in crowd speed is necessary for the speeds the operator is requesting of the mining shovel, a speed assessment decision 330 receives a crowd speed command 332, in appropriate units, that represents the crowd speed being requested by the operator and compares the crowd speed command 332 with the crowd motor speed limit 322. If the speed assessment decision 330 determines the crowd speed command 332 exceeds the crowd motor speed limit 322, the speed reduction function 300 can perform a limit motor speed step 334 that limits or reduces the available speed associated with the crowd motor. Hence, once the dipper assembly strikes the bank face, the speed reduction function 300 reduces or limits the available speed of the crowd motor and thus velocity of the dipper assembly. Because the crowd motor speed limit 322 can fall anywhere within the crowd motor speed range 324, the speed output of the crowd motor may fall anywhere between full motor speed 236 and zero.

Instead of or in addition to performing the interpolation step 320, the speed reduction function 300, in a second embodiment 350, can be configured to perform a relatively less complex process to avoid requiring excessive motor speeds from the crowd motor. For example, if the calculated crowd force 272 is above a certain percentage of the first crowd threshold 282, indicating the crowd system is exceeding capacity, the second embodiment 350 may reduce or limit the available crowd motor speed by a constant, invariable value. To accomplish this, the second embodiment 350 may receive the first crowd force threshold 282 and, in a percent determination step 352, determine a percentage or fraction of the first crowd force threshold 282, for example, 90%. The exact percentage of the first crowd force threshold 282 may be set so that any values below that percentage are considered to be within the capabilities of the mining shovel. The second embodiment 350, in a third comparison step 354, compares the determined percentage of the first crowd force threshold 282 with the calculated crowd force 272 to determine whether to limit or reduce the available crowd motor speed in a second limit motor speed step 356. The second limit motor speed step 356 may be based on a predefined crowd motor speed limit 358, for example, in units of RPM, hertz, feet or meters per second, etc. Because the second embodiment 350 limits or reduces crowd speed or the available crowd speed based on a percentage of the first crowd force threshold 282, the speed reduction function 300 utilizing the second embodiment 350 may reduce the crowd speed even when the impact forces do not exceed the thresholds. This may help reduce over speed conditions in which the crowd motor is operating at excessive speeds, which may happen, for example, when crowding the dipper toward the bank with the dipper assembly is generally vertical such that the dipper weight accelerates the dipper assembly in the crowding direction.

INDUSTRIAL APPLICABILITY

Figure 5:
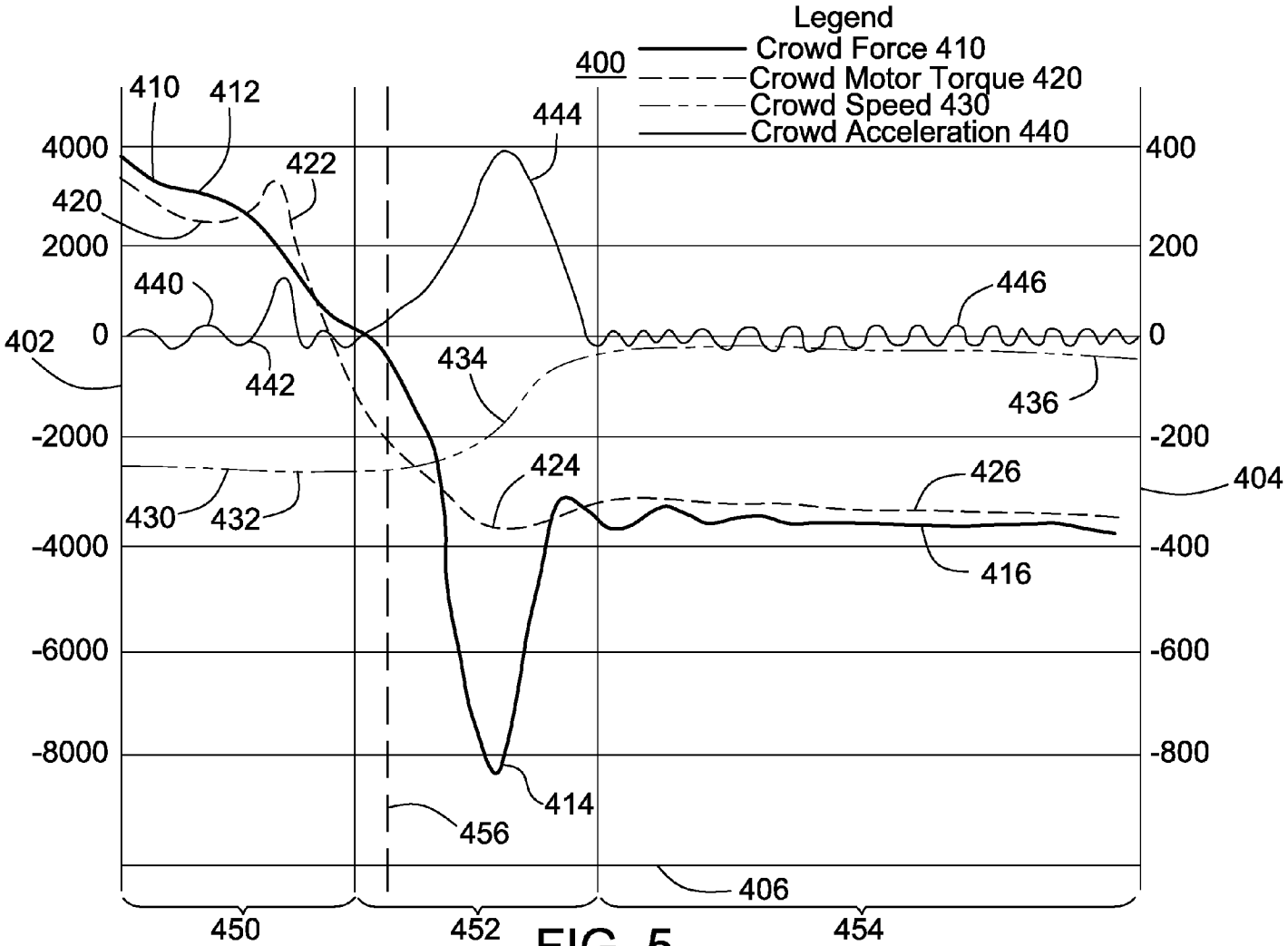
FIG. 5 is a chart representing the crowd forces being generated and applied during a digging operation.

The present disclosure describes a system and process for determining if the dipper of a mining shovel or similar mining machine has impacted against the vertical bank of a mine site during a digging operation. Further, the disclosure provides possible measures that may assist in operation of the mining shovel and reducing undue stresses applied to the mining shovel during and after impact. Referring to FIG. 5, there is illustrated a chart 400 that depicts a representative example of the forces and speeds generated by a digging operation proximate to the time the dipper strikes the bank. In the chart, the vertical left side Y-axis 402 may represent forces applied to the various components of the digging assembly measured in, for example, newton-meters. The right side Y-axis 404 may represent velocity and/or acceleration in units of radians per second$^2$, RPMs, hertz, or feet or meters per second$^2$. The lower, horizontal X-axis 406 may represent time in seconds. The positive and negative signs attributed to the forces and speed-based parameters along the Y-axes 402, 404 are made in reference to the direction the dipper assembly 130 is moving and may increase during retraction and decrease during crowding. Hence, the positive and negative signs associated with the forces and speeds should be interpreted as a change in the direction that the forces are applied to the crowd system rather than a change in the absolute force or speed applied to the crowd system.

The chart 400 may represent the variation over time of various variables and parameters associated with the mining shovel in general and digging operation in particular This information may include the calculated crowd force 410 (thick solid line) as applied to the crowd actuator generally and, in the present embodiment, to the crowd ropes in particular as determined in the manner described above. The calculated crowd force may correspond to the estimated tension or lack of tension on the crowd ropes. In addition to the calculated crowd force 410, the chart 400 may also represent the crowd motor torque 420 (dashed line) generated and output from the crowd motor. Regarding speed-associated parameters and variables, the chart 400 may depict the crowd speed 430 (long and short dashed line) as measured from the crowd motor or another source associated with the crowd system. The chart 400 presents the crowd acceleration 440 (thin solid line) associated with the crowd system and that may be based on the crowd speed 430 as converted to acceleration by calculation through Eqn. 2 above. As described above, during a digging operation, the operator initially positions the dipper assembly proximate to the toe of the bank face at the mine site, strikes the dipper into the bank, then continues to crowd the dipper to penetrate the bank and fill with material. These temporal stages can be represented in chart 400 as an initial maneuvering stage 450, an impact stage 452, and a penetration stage 454.

During the maneuvering stage 450, the operator initially maneuvers the dipper assembly proximate to the toe, an activity that requires a varying production of crowd motor torque 420, but not an extensive expenditure of crowd motor torque, as indicated by the variable first torque region 422 of the line representing the crowd motor torque 420. Because there are no other forces significantly affecting or resisting the crowd ropes from moving the dipper assembly, the calculated crowd force 410 during this activity may produce a first crowd force region 412 that closely tracks the force fluctuations of the variable first torque region 422 associated with the crowd motor torque 420, indicating that forces applied to the crowd ropes primarily originate from the crowd motor. During these maneuvers, the operator may move the dipper assembly at a relatively consistent speed with minor variations in acceleration, for example, due to directional changes corresponding to the swinging motion of the dipper. The crowd speed 430 may be relatively consistent with the crowd acceleration 440 being low or nonexistent and therefore provide a first constant speed region 432 and a first constant acceleration region 442.

When the dipper strikes the bank during the impact stage 452, the forces and speeds associated with the dipper assembly change considerably. As reflected in the chart 400, changes between positive and negative values should be considered as reflecting directional changes in the application of force and/or speed rather than changes in absolute magnitude. In particular, the crowd speed 430 slows as indicated by the speed change region 434 as the material of the bank opposes or counteracts the crowding speed and direction of the dipper assembly. Impact also causes the crowd acceleration 440 to change abruptly, as represented by the acceleration change region 444, as the dipper assembly promptly decelerates. The torque output of the crowd motor torque 420 may also change during the impact stage 452. In particular, impact may cause the crowd motor to momentarily produce a peak torque 424, then stall at which point the rotational speed output of the crowd motor may be approximately or substantially zero. The impact, however, applies significant stress to the crowd actuator and, in particular, the crowd ropes as the reactionary forces generated by the dipper striking the bank propagate through the dipper assembly and digging assembly of the mining shovel. When the reactionary forces due to impact and applied to the crowd ropes are isolated, the quantity of the calculated crowd force 410 may attain a crowd force peak 414 as shown in the chart 400. The crowd force peak 414 may exceed the peak torque 424 of the crowd motor, perhaps by twice as much or more. The electronic controller may recognize or register this condition, specifically calculated as calculated crowd force peak>peak motor torque, as occurring proximate to the point of impact, i.e. the impact event 456. In actuality, the impact event 456 would occur temporally just before the crowd force peak 414 and the peak torque 424 produced by the crowd motor, as indicated in the chart 400 of FIG. 4.

Once the electronic controller registers the impact event 456, the electronic controller may execute routines to reduce the output of the crowd system in general and the crowd motor in particular. For example, during the impact stage 452 and subsequently during the penetration stage 454, the crowd motor torque 420 may be reduced or limited to the maximum continuous stall torque 426, or a percentage thereof, of the crowd motor to avoid overheating and/or excessive current draw. Also during the penetration stage 454, the crowd speed 430 and the crowd acceleration 440 may enter a second constant speed region 436 and a second constant acceleration region 446 as the dipper steadily engages the bank and fills with material. After the impact event 456, the reactionary forces may dissipate and the calculated crowd force 410 may also be reduced and correspond to the maximum continuous stall torque 426 by producing a second crowd force region 416. This may indicate that the net forces acting on the dipper assembly generally originate from the crowd motor and the inertia or momentum associated with the dipper assembly, and that the potentially harmful reactionary forces from the impact event have been reduced.

Hence, the disclosure can determine if a dipper on a mining shovel or similar machine strikes a bank or similar surface at a mining site using a calculated crowd force rather than another parameter which may not accurately reflect or correspond to the reactionary forces generated during impact but to some other conditions. The values used for the calculations may be taken from existing system variables and may be continuously monitored to provide real time feedback regarding the forces being applied to the crowd system while digging. Once an impact is detected, the disclosure may further provide processes and routines for reducing crowd motor torque and/or speed to assist in operation of the mining shovel to facilitate bank penetration and efficiency, reduce undue structural loads, and to prevent overheating of the crowd motor due to excessive current draw.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A mining machine comprising:

a digging assembly including a boom extending generally upwardly between a lower end and an upper end;

a dipper assembly including a dipper arm and a dipper disposed at a first end of the dipper arm, the dipper assembly slidably supported by the boom, a crowd system for slidably moving the dipper assembly with respect to the boom in a crowd direction and in a retraction direction, the crowd system including a crowd motor, and a crowd actuator operatively associated with the crowd motor and arranged to slide the dipper arm with respect to the boom; and an electronic controller operatively associated with the crowd system and in electronic communication with the crowd motor, the electronic controller configured to calculate a calculated crowd force and to detect an impact event where the dipper assembly impacts a surface at a mining site based on the calculated crowd force;

wherein the electronic controller receives a crowd speed associated with the dipper assembly sliding with respect to the boom and calculates the calculated crowd force based in part on the crowd speed;

wherein the electronic controller is configured to reduce the crowd speed based on a crowd motor speed limit if the impact event is detected; and wherein the electronic controller receives a crowd motor force range and a crowd motor speed range and interpolates the crowd motor speed limit corresponding to the calculated crowd force from the crowd motor force range and the crowd motor speed range.

2. The mining machine of claim 1, wherein the electronic controller converts the crowd speed to a crowd acceleration.

3. The mining machine of claim 2, wherein the electronic controller receives an inertia parameter associated with the dipper assembly.

4. The mining machine of claim 3, wherein the electronic controller calculates an inertial crowd force based on the inertia parameter and the crowd acceleration.

5. The mining machine of claim 4, wherein the electronic controller receives a crowd motor torque from the crowd motor and calculates the calculated crowd force by subtracting the inertial crowd force from the crowd motor torque.

6. The mining machine of claim 5, wherein the electronic controller receives a first crowd force threshold and compares the first crowd force threshold with the calculated crowd force to register the impact event.

7. The mining machine of claim 1, wherein the electronic controller is configured to modify the crowd motor torque if the impact event is detected.

8. The mining machine of claim 7, wherein the electronic controller calculates a torque command modifier based on a difference between the calculated crowd force and a first crowd force threshold and applies the torque command modifier to a crowd force command received from an operator input device to modify the crowd motor torque.

9. The mining machine of claim 1, wherein the crowd motor force range extends between a first crowd force threshold and a second crowd force threshold associated with the crowd motor, and the crowd motor speed range extends between a full motor speed associated with the crowd motor and zero.

10. The mining machine of claim 1, wherein the electronic controller determines a percentage of a first crowd force threshold, compares the percentage of the first crowd force threshold to the calculated crowd force, and applies the crowd motor speed limit if the calculated crowd force exceeds the percentage of the first crowd force threshold.

11. A method of operating a mining machine comprising:

crowding a dipper assembly supported by a boom arranged in an upward orientation on the mining machine toward a surface of a mining site;

monitoring a crowd motor torque output from a crowd motor operatively associated with the dipper assembly;

monitoring a crowd speed associated with the dipper assembly;

receiving an inertia parameter associated with the dipper assembly;

calculating a calculated crowd force based in part on the crowd motor torque, the crowd speed, and the inertia parameter;

registering an impact event where the dipper assembly strikes the surface if the calculated crowd force exceeds a first crowd threshold; and reducing the crowd speed based on the a crowd motor speed limit if the impact event is detected; wherein reducing the crowd speed includes:

receiving a crowd motor force range and crowd motor speed range; and interpolating the crowd motor speed limit corresponding to the calculated crowd force from the crowd motor force range and the crowd motor speed range.

12. The method of claim 11, further comprising modifying the crowd motor torque if the impact event is detected.

13. The mining machine of claim 12, wherein the step of modifying the crowd motor torque includes calculating a torque command modifier based on a difference between the calculated crowd force and a first crowd threshold.

* * * * *